US012137853B2

(12) United States Patent
Zhang et al.

(10) Patent No.: US 12,137,853 B2
(45) Date of Patent: Nov. 12, 2024

(54) CLEANING ROBOT

(71) Applicant: Yunjing Intelligence Technology (Dongguan) Co., Ltd., Dongguan (CN)

(72) Inventors: Junbin Zhang, Dongguan (CN); Jibiao Huang, Dongguan (CN); Weijin Lin, Dongguan (CN)

(73) Assignee: YUNJING INTELLIGENCE TECHNOLOGY (DONGGUAN) CO., LTD., Dongguan (CN)

( * ) Notice: Subject to any disclaimer, the term of this patent is extended or adjusted under 35 U.S.C. 154(b) by 421 days.

(21) Appl. No.: 17/359,012

(22) Filed: Jun. 25, 2021

(65) Prior Publication Data

US 2021/0321851 A1 Oct. 21, 2021

Related U.S. Application Data

(63) Continuation of application No. PCT/CN2019/113913, filed on Oct. 29, 2019.

(30) Foreign Application Priority Data

Dec. 28, 2018 (CN) ..... 201811628368.7

(51) Int. Cl.
*A47L 11/40* (2006.01)
*A47L 11/24* (2006.01)
*A47L 11/283* (2006.01)

(52) U.S. Cl.
CPC ..... *A47L 11/24* (2013.01); *A47L 11/283* (2013.01); *A47L 11/4036* (2013.01);
(Continued)

(58) Field of Classification Search
CPC .... A47L 11/24; A47L 11/4036; A47L 11/283; A47L 11/28; A47L 11/282; A47L 11/4038; A47L 2201/00; A47L 11/40
(Continued)

(56) References Cited

U.S. PATENT DOCUMENTS

2005/0015913 A1 1/2005 Kim et al.
2016/0309975 A1* 10/2016 Lindhé ..... A47L 9/2852
(Continued)

FOREIGN PATENT DOCUMENTS

CN 1575724 A 2/2005
CN 104856613 A 8/2015
(Continued)

OTHER PUBLICATIONS

First Office Action issued in counterpart Chinese Patent Application No. 201811628368.7, dated Jan. 22, 2020.
(Continued)

*Primary Examiner* — Laura C Guidotti
*Assistant Examiner* — Sharonda T Felton

(57) ABSTRACT

A cleaning robot is disclosed, the cleaning robot includes a robot body provided with a sweeping rotation element and a mopping rotation element at different positions at a bottom thereof; a drive device provided on the robot body and configured for driving the sweeping rotation element and the mopping rotation element to rotate; wherein the sweeping rotation element is provided to be detachably connected with the sweeping module, and the sweeping module is configured for sweeping a floor; the mopping rotation element is provided to be detachably connected with the mopping module, and the mopping module is configured for mopping the floor. In this way, the cleaning robot has various functions and better cleaning effects.

7 Claims, 12 Drawing Sheets

(52) U.S. Cl.
CPC ..... *A47L 11/4038* (2013.01); *A47L 11/4066* (2013.01); *A47L 11/4011* (2013.01); *A47L 2201/00* (2013.01)

(58) Field of Classification Search
USPC ..... 15/49.1, 150.1, 50.2
See application file for complete search history.

(56) References Cited

U.S. PATENT DOCUMENTS

| | | | | |
|---|---|---|---|---|
| 2016/0331200 | A1 | 11/2016 | Yang et al. | |
| 2017/0325648 | A1 | 11/2017 | Huang | |
| 2017/0332863 | A1* | 11/2017 | Zhang | A47L 11/302 |
| 2018/0184871 | A1 | 7/2018 | Sun et al. | |
| 2019/0191952 | A1* | 6/2019 | Johnson | A47L 11/4011 |

FOREIGN PATENT DOCUMENTS

| | | | |
|---|---|---|---|
| CN | 204931578 | U | 1/2016 |
| CN | 205181254 | U | 4/2016 |
| CN | 105852733 | A | 8/2016 |
| CN | 105982625 | A | 10/2016 |
| CN | 106419760 | A | 2/2017 |
| CN | 106901665 | A | 6/2017 |
| CN | 206659755 | U | 11/2017 |
| CN | 107440613 | A | 12/2017 |
| CN | 104771112 | B | 4/2018 |
| CN | 207202833 | U | 4/2018 |
| CN | 207640328 | U | 7/2018 |
| CN | 108372508 | A | 8/2018 |
| CN | 108903847 | A | 11/2018 |
| CN | 108968830 | A | 12/2018 |
| CN | 208176530 | U | 12/2018 |
| CN | 208243519 | U | 12/2018 |
| CN | 109645893 | A | 4/2019 |
| JP | H0456454 | U | 5/1992 |
| JP | 2014071691 | A | 4/2014 |
| JP | 2017012489 | A | 1/2017 |
| JP | 2018097865 | A | 6/2018 |
| JP | 2018099293 | A | 6/2018 |
| KR | 1020050012047 | A | 1/2005 |
| KR | 100669888 | B1 | 1/2007 |
| KR | 200475481 | Y1 | 12/2014 |
| KR | 20160002843 | U | 8/2016 |
| TW | 201831132 | A | 9/2018 |
| WO | 2016126145 | A1 | 8/2016 |
| WO | 2018012921 | A1 | 1/2018 |
| WO | 2018108144 | A1 | 6/2018 |

OTHER PUBLICATIONS

International Search Report and Written Opinion issued in corresponding PCT Application No. PCT/CN2019/113913, dated Jan. 23, 2020.
Second Office Action issued in counterpart Chinese Patent Application No. 201811628368.7, dated Jul. 13, 2020.
Decision to Grant a Patent issued in counterpart Japanese Patent Application No. 2021-536317, dated Aug. 30, 2022.
Examination Report No. 1 issued in counterpart Australian Patent Application No. 2019415834, dated Aug. 9, 2022.
First Office Action issued in counterpart Taiwanese Patent Application No. 108141361, dated Apr. 14, 2020.
Notice of Approval issued in counterpart Taiwanese Patent Application No. 108141361, dated Dec. 22, 2021.
Notice of Reasons for Refusal issued in counterpart Japanese Patent Application No. 2021-536317, dated Jun. 28, 2022.
Second Office Action issued in counterpart Taiwanese Patent Application No. 108141361, dated Jun. 15, 2021.
Supplementary European Search Report issued in counterpart European Patent Application No. 19905718.3, dated Aug. 26, 2022.
Third Office Action issued in counterpart Taiwanese Patent Application No. 108141361, dated Sep. 23, 2021.

* cited by examiner

CLEANING ROBOT

CROSS REFERENCE TO RELATED APPLICATIONS

The present application is the continuation application of the International Application No. PCT/CN2019/113913, filed on Oct. 29, 2019, which claims priority to Chinese patent application No. 201811628368.7, filed on Dec. 28, 2018 in the Chinese Patent Office and titled "Cleaning Robot", the entire contents of which are incorporated herein by reference.

FIELD

The present application relates to a technology field of a cleaning device, particularly to a cleaning robot.

BACKGROUND

With the progressive of the technology and the increase of the living standard, the cleaning robots become more popular. However, in related art, the cleaning robots are generally sweeping robots. The sweeping robots only have a single function of sweeping the floor.

In current some cleaning robots also have a sweeping and mopping integration mode, that is, the fronts of the cleaning robots sweep while the rears of the cleaning robots mop simultaneously, such that the cleaning robots implement two functions of sweeping and mopping. However, mopping modules of the cleaning robots of the sweeping and mopping integration mode will moisten the floor when mopping the floor, resulting in being harmful to the sweeping of the sweeping modules on the floor. In addition, when the cleaning robot of the sweeping and mopping integration mode is cleaning the floor, the front sweeping module will miss unswept garbage and dust, which makes the mop behind the cleaning robot easy to get dirty, which will cause the mopping to be unclean. Moreover, after the existing cleaning robot of the sweeping and mopping integration mode mops the floor, it is easy to produce sewage stains on the floor.

SUMMARY

Based on such reasons, the purpose of the present application is to provide a cleaning robot, which has various cleaning functions and better cleaning effects.

In order to implement the above-mentioned purpose, the present application provides the following technical solution:

a cleaning robot, including:

a robot body provided with a sweeping rotation element and a mopping rotation element in different positions at a bottom thereof;

a drive device provided on the robot body and configured for driving the sweeping rotation element and the mopping rotation element to rotate;

a sweeping module and a mopping module with either one of which being installed on the robot body;

wherein the sweeping rotation element is provided to be detachably connected with the sweeping module, and the sweeping module is configured for sweeping a floor;

the mopping rotation element is provided to be detachably connected with the mopping module, and the mopping module is configured for mopping the floor.

When the cleaning robot provided according to the embodiment of the present application is used, the sweeping rotation element and the mopping rotation element are provided in different positions at the bottom of the robot body, and the drive device can drive the sweeping rotation element and the mopping rotation element to rotate. According to actual requirement, the sweeping rotation element can be connected with the sweeping module. After the sweeping rotation element is connected with the sweeping module, a rotation of the sweeping rotation element drives the sweeping module to rotate to implement the sweeping module sweeping the floor. Or, the mopping rotation element can be connected with the mopping module, after the mopping rotation element is connected with the mopping module, a rotation of the mopping rotation element drives the mopping module to rotate to implement the mopping module mopping the floor. In this way, the cleaning robot of the embodiment of the present application can implement sweeping and mopping functions with fewer elements. When using the sweeping module, the cleaning robot can sweep the floor, and when using the mopping module, the cleaning robot can clean the floor. In this way, the sweeping and mopping of the cleaning robot on the floor are not affected by each other, and the cleaning effect of the sweeping module and the mopping module on the floor can be increased through the transmission of the sweeping rotation element and the mopping rotation element, so that the cleaning robot has various cleaning functions and better cleaning effects.

DETAILED DESCRIPTION OF THE EMBODIMENTS

The technical solutions in the embodiments of the present application will be described clearly and completely in conjunction with the accompanying drawings in the embodiments of the present application as below. Obviously, the described embodiments are only a part of the embodiments of the present application, rather than all the embodiments.

The embodiment of the present application provides a cleaning robot 100 that can be configured for automatically cleaning a floor. The application scenarios of the cleaning robot 100 can be household indoor cleaning, large-scale place cleaning, etc.

Figure 1:
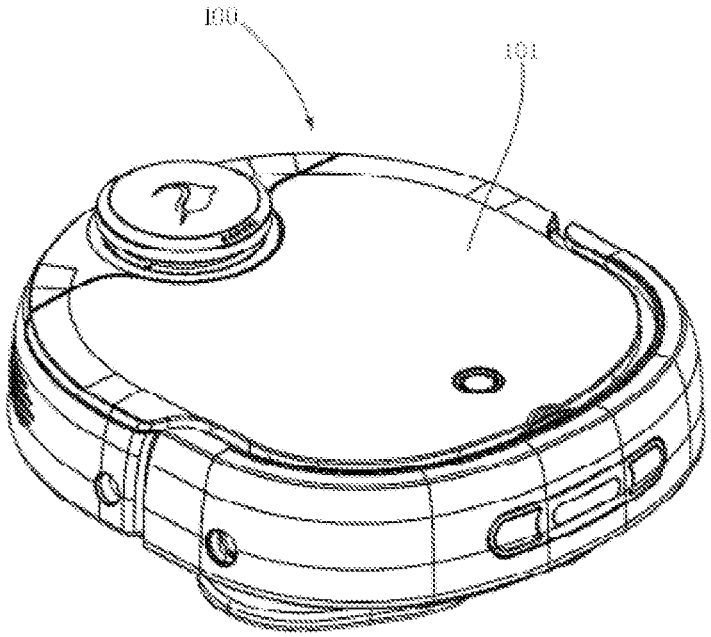
FIG. 1 is a schematic perspective view of a cleaning robot provided according to an embodiment of the present application.
Figure 2:
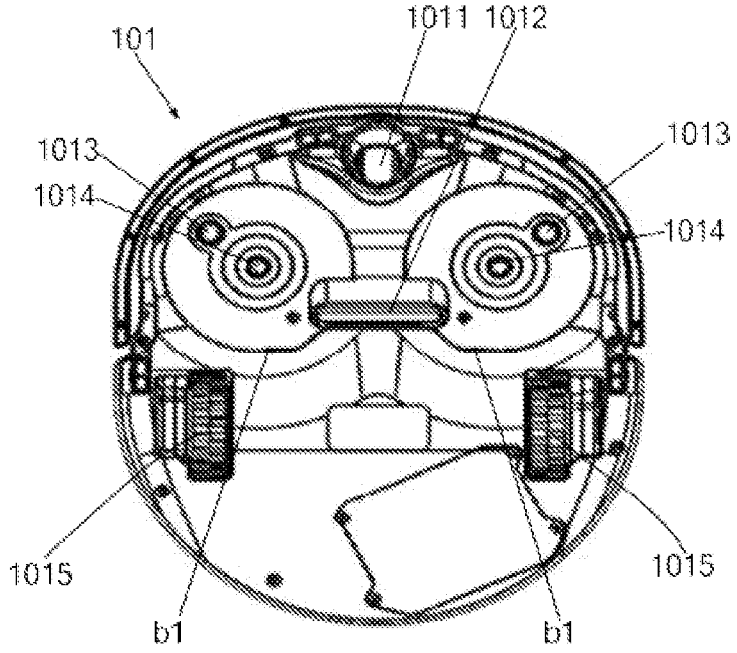
FIG. 2 is a schematic bottom view of a robot body provided according to an embodiment of the present application.

A type of the cleaning robot 100 provided in the embodiment of the present application is a cleaning robot that can switch between a sweeping mode and a mopping mode. The cleaning robot 100 includes a robot body 101 that can be connected with the sweeping module 103 to sweep the floor; or the robot body 101 can be connected with the mopping module 102 to mop the floor. As shown in FIGS. 1 and 2, the cleaning robot 100 includes a robot body 101 and a walking unit that drives the robot body 101 to move. The robot body 101 can be a circular structure, a square structure, etc. In the embodiment of the present application, the robot body 101 of D-shaped structure is taken as an example for description. As shown in FIG. 1, a front part of the robot body 101 is a rectangular structure with rounded corners, and a rear part of the robot body 101 is a semicircular structure. In the embodiment of the present application, the robot body 101 has a left-right symmetric structure.

The walking unit is a component related to the movement of the cleaning robot 100. The walking unit includes, for example, a drive wheel 1015 and a universal wheel 1011. The universal wheel 1011 cooperates with the drive wheel 1015 to implement the steering and movement of the cleaning robot 100. At a rear of a bottom of the robot body 101, a drive wheel 1015 is provided on each of left and right sides. The universal wheel 1011 is provided on a center line of the bottom of the robot body 101 and is located between two cleaning elements. The cleaning robot 100 includes the cleaning elements, which is configured for cleaning the floor. The cleaning elements can be components on the sweeping module 103 for sweeping the floor, specifically cleaning brushes 1031 of the sweeping module 103, or the cleaning elements are components (for example, mops 1021) on the mopping module 102 for mopping the floor. The cleaning elements are provided at the bottom of the robot body 101.

Each of the drive wheels 1015 is provided with a drive wheel motor. The drive wheel 1015 rotates under the driving of the drive wheel motor. After the drive wheel 1015 rotates, it drives the cleaning robot 100 to move. The steering angle of the cleaning robot 100 can be controlled by controlling a speed difference between a right drive wheel 1015 and a left drive wheel 1015.

The robot body 101 is also provided with a dust suction bin and a blower fan. A dust suction inlet 1012 of the dust suction bin is located at the bottom of the robot body 101. The blower fan rotates to form a negative pressure in the dust suction bin to suck dust, paper scraps, etc. through the dust suction inlet 1121. The dust box is provided inside the dust suction bin, the garbage is collected and temporarily stored in the dust box.

It should be understood that the cleaning robot 100 described in the embodiment of the present application is only a specific example, and does not specifically limit the cleaning robot 100 in the embodiments of the present application. The cleaning robot 100 of the present application can also be implemented in other specific implementations. For example, in other implementations, the cleaning robot can have more or fewer components than the cleaning robot 100 shown in FIG. 1.

The implementation of the cleaning robot provided in the following embodiments of the present application can refer to the implementation of the cleaning robot in the embodiment shown in FIG. 1.

As shown in FIG. 2, the first embodiment of the present application provides a cleaning robot 100, which includes a robot body 101. A sweeping rotation element 1013 and a mopping rotation element 1014 are provided in different positions of the bottom of the robot body 101. The cleaning robot 100 further includes a drive device 1016 provided on the robot body 101. The drive device 1016 is configured for driving the sweeping rotation element 1013 and the mopping rotation element 1014 to rotate. The sweeping rotation element 1013 is configured for being detachably connected with the sweeping module 103. The sweeping module 103 is configured for sweeping the floor. The mopping rotation element 1014 is configured for being detachably connected with the mopping module 102. The mopping module 102 is configured for mopping the floor.

When the cleaning robot 100 provided in the first embodiment of the present application is used, the sweeping rotation element 1013 can be connected with the sweeping module 103 according to actual requirement. After the sweeping rotation element 1013 is connected with the sweeping module 103, a rotation of the sweeping rotation element 1013 drives the sweeping module 103 to rotate to implement sweeping on the floor. Or, the mopping rotation element 1014 can be connected with the mopping module 102. After the mopping rotation element 1014 is connected with the mopping module 102, the mopping rotation element 1014 drives the mopping module 102 to rotate to implement the mopping on the floor.

In a specific example of a user using the cleaning robot 100, when to clean the floor, the user can first choose to connect the sweeping rotation element 1013 with the sweeping module 103. The rotation of the sweeping rotation element 1013 drives the sweeping module 103 to rotate to implement the sweeping on the floor. After the cleaning robot 100 finish the cleaning up of the garbage and dust on the floor, the user can detach the sweeping module 103 from the robot body 101, and then choose to connect the mopping rotation element 1014 with the mopping module 102. The mopping rotation element 1014 drives the mopping module 102 to rotate to implement the mopping on the floor, thereby the cleaning robot 100 can implement the mopping on the floor.

The cleaning robot 100 provided in the embodiment of the present application avoids the situation that the sweeping module 103 and the mopping module 102 work at the same time, thereby avoiding the situation that the mopping module 102 drags a lot of garbage, dust and produces a lot of sewage stains during the mopping process. A best cleaning effect is obtained through the single function of sweeping or mopping the floor.

In the above-mentioned first embodiment, due to that the sweeping module 103 and the mopping module 102 are connected with the robot body 101 through the sweeping rotation element 1013 and the mopping rotation element 1014 respectively, and a position of the sweeping rotation element 1013 and a position of the mopping rotation element 1014 are different and not influenced by each other. The positions of the sweeping rotation element 1013 and the mopping rotation element 1014 at the bottom of the robot body 101 can be set by the user according to the actual requirement, thereby it achieves that the positions of the sweeping module 103 and the mopping module 102 after being connected with the robot body 101 can be set by users according to actual requirements.

Figure 3:
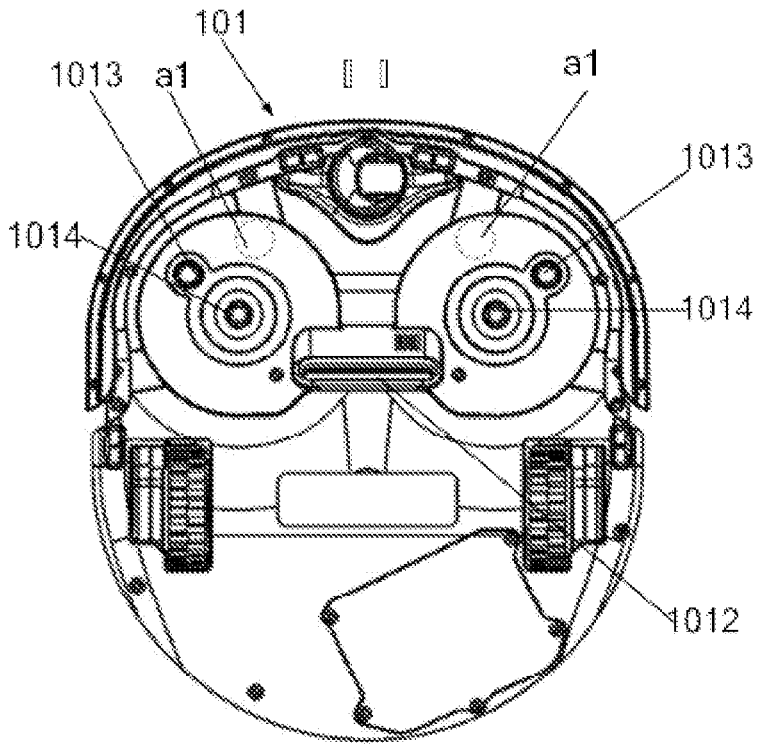
FIG. 3 is a schematic bottom view of a robot body provided according to another embodiment of the present application.

Optionally, as shown in FIGS. 2 and 3, the sweeping rotation element 1013 is located in front of the mopping rotation element 1014 along a first direction, and meanwhile the sweeping rotation element 1013 is located in front of the mopping rotation element 1014 along a second direction. The first direction is a forward movement direction of the cleaning robot 100, the second direction is perpendicular to the forward movement direction of the cleaning robot 100, and the second direction points to a target side of the robot body 101. The target side is a side between a foremost position and a last position of the robot body 101 along the forward movement direction of the cleaning robot 100. Specifically, the target side can be a left side or a right side between the foremost position and the last position of the robot body 101 along the forward movement direction of the cleaning robot 100. The forward movement direction of the cleaning robot 100 is a direction when the cleaning robot 100 moves forward without turning.

In this way, the sweeping rotation element 1013 is located in front of the mopping rotation element 1014 along the first direction, and as compared to the mopping rotation element 1014, the sweeping rotation element 1013 is closer to an edge of a head of the robot body 101. The sweeping rotation element 1013 is located in front of the mopping rotation element 1014 along the second direction, and as compared to the mopping rotation element 1014, the sweeping rotation element 1013 is closer to the target side of the robot body 101. For example, when the target side is the left side between the foremost position and the last position of the robot body 101 along the forward movement direction of the cleaning robot 100, the sweeping rotation element 1013 is closer to the left side than the mopping rotation element 1014. When the target side is the right side between the foremost position and the last position of the robot body 101 along the forward movement direction of the cleaning robot 100, the sweeping rotation element 1013 is closer to the right side than the mopping rotation element 1014. In other words, the sweeping rotation element 1013 is located at a left front or a right front of the mopping rotation element 1014 along the forward movement direction of the cleaning robot 100.

With such arrangement, when the sweeping module 103 includes a cleaning brush 1031 and a rotation shaft of the cleaning brush 1031 coincides with a rotation shaft of the cleaning sweeping rotation element 1013, the rotation shaft of the cleaning brush 1031 on the sweeping module 103 is closer to the edge of the head of the robot body 101 and an edge of the target side, ensuring that a length of the cleaning brush 1031 is more reasonable. The cleaning brush 1031 can sweep the peripheral region but avoid the length of the cleaning brush 1031 being too long. If the length of the cleaning brush 1031 is too long, a linear velocity of an end of the cleaning brush 1031 will be higher, thereby during the end of the cleaning brush 1031 sweeping garbage, it is prone to throw the garbage out, that is, the garbage is thrown off the cleaning robot 100. In the first embodiment, along the forward movement direction of the cleaning robot 100, after the sweeping rotation element 1013 is located at the left front or the right front of the mopping rotation element 1014, a sweeping transmission element 1032 is closer to an edge of the robot body 101, thereby the cleaning brush 1031 can be set closer to the edge of the robot body 101. In this way, even if length of bristles of the cleaning brush 1031 is shorter, a cleaning range of the cleaning brush 1031 can extend out of the edge of the robot body 101. In this way, the length of the bristles of the cleaning brush 1031 is designed to be reasonable, preventing the garbage from being thrown off the cleaning robot 100 through the cleaning brush 1031. In the embodiment of the present application, the cleaning brush 1031 can sweep garbage to the dust suction inlet 1012 at the bottom of the cleaning robot 100, and the garbage is sucked from the dust suction inlet 1012 to the dust suction bin in the cleaning robot 100 for temporary storage, thereby improving the cleaning effect.

It should be understood that in other specific implementations of the first embodiment, the sweeping rotation element 1013 can also be located behind the mopping rotation element 1014 along the first direction, and/or, the sweeping rotation element 1013 is located behind the mopping rotation element 1014 along the second direction, which is not specifically limited in the embodiment of the present application.

Optionally, in the above-mentioned first embodiment, when the robot body 101 is placed on a plane with the bottom of the robot body 101 facing the plane, the rotation shaft of the sweeping rotation element 1013 is perpendicular to the plane, and the rotation shaft of the mopping rotation element 1014 is also perpendicular to the plane. At this time, after the sweeping module 103 is connected with the robot body 101, the rotation of the sweeping rotation element 1013 drives the sweeping module 103 to rotate. A rotation plane where the cleaning brush 1031 of the sweeping module 103 is located is parallel to the above-mentioned plane, thereby ensuring that the sweeping module 103 is subjected to a balance force during the rotation and also ensuring the cleaning effect of uniformly cleaning the floor.

When the robot body 101 is placed on the plane to work, the rotation shaft of the mopping rotation element 1014 is perpendicular to the above-mentioned plane. After the mopping module 102 is connected with the robot body 101, the rotation of the mopping rotation element 1014 drives the mopping module 102 to rotate. A rotation plane where the mop 1021 of the mopping module 102 is located is parallel to the above-mentioned plane, thereby ensuring that the mopping module 102 is subjected to a balance force during the rotation and also ensuring the cleaning effect of uniformly cleaning the floor.

In the embodiment of the present application, the robot body 101 is placed on the plane with the bottom of the robot body 101 facing the plane, that is, the robot body 101 is placed on the plane when working, specifically, the walking unit provided at the bottom of the robot body 101 contacts the plane. The robot body 101 is supported on the plane through the walking unit. At this time, the cleaning robot 100 can clean the plane.

In an implementation in which the bottom of the robot body 101 includes a planar structure, when the robot body 101 is placed on the plane, the planar structure at the bottom of the robot body 101 can be parallel to the plane. The rotation shaft of the sweeping rotation element 1013 is perpendicular to the planar structure, the rotation shaft of the mopping rotation element 1014 is also perpendicular to the planar structure. Of course, in some examples, the planar structure at the bottom of the robot body 101 can be inclined to the plane where the robot body 101 is placed. Of course, when the robot body 101 is placed on the plane, the rotation shaft of the sweeping rotation element 1013 can be slightly inclined relative to the plane, and the rotation shaft of the mopping rotation element 1014 can be slightly inclined relative to the plane, which is not specifically limited here.

As shown in FIGS. 4-8, the embodiments of the present application also provide a second embodiment, which is an improved solution based on the first embodiment. In the second embodiment, the cleaning robot 100 further includes a mopping module 102, the mopping module 102 is detachably connected with the mopping rotation element 1014. The mopping module 102 includes a turntable 1022 and a mop 1021, where the mop 1021 is configured for mopping the floor, and the mop 1021 is provided on the turntable 1022. The mop 1021 can be detachably connected with the turntable 1022. The turntable 1022 is detachably connected with the mopping rotation element 1014. The mopping rotation element 1014 is configured for driving the mopping module 102 to rotate after the turntable 1022 is connected with the mopping rotation element 1014. In other words, after the turntable 1022 is connected with the mopping rotation element 1014, the mopping rotation element 1014 drives the turntable 1022 to rotate, and then the turntable 1022 drives the mop 1021 to rotate. The rotating mop 1021 rubs against the floor, and the mop 1021 mopping the floor is implemented.

In the second embodiment, after the turntable 1022 is connected with the mopping rotation element 1014, a rotation shaft of the mopping rotation element 1014 coincides with a rotation shaft of the turntable 1022. Of course, after the turntable 1022 is connected with the mopping rotation element 1014 for transmission, the rotation shaft of the mopping rotation element 1014 and the rotation shaft of the turntable 1022 can also be parallel to each other and be in different positions. For example, a gear is provided between the turntable 1022 and the mopping rotation element 1014, the mopping rotation element 1014 drives the gear to rotate, and the gear drives the turntable 1022 to rotate.

In the second embodiment, there are many ways to connect the mopping module 102 with the robot body 101. A few examples are listed below:

Example 1

The mopping module 102 is connected with the robot body 101 through the turntable 1022 of the mopping module 102 and the mopping rotation element 1014. Specifically, a detachable connection of the turntable 1022 and the mopping rotation element 1014 is implemented through a magnetic connection structure. The magnetic connection structure includes a magnetic element and a metal element, or the magnetic connection structure includes two magnetic elements with opposite north and south poles. In the embodiment of the present application, the magnetic element can be a permanent magnet, an electromagnet, etc. For example, one of the magnetic element and the metal element is provided on the turntable 1022, and the other of the magnetic element and the metal element is provided on the mopping rotation element 1014. In this way, when to connect the turntable 1022 with the mopping rotation element 1014, the magnetic element can be magnetically connected with the metal element. Or, a part of the turntable 1022 configured for contacting the mopping rotation element 1014 is a magnetic element, and a part of the mopping rotation element 1014 configured for contacting the turntable 1022 is a metal element.

Example 2

The mopping module 102 includes the turntable 1022, the mop 1021 and an installation body. The mop 1021 is connected with the turntable 1022, the installation body is detachably connected with the robot body 101, the turntable 1022 is rotatably connected with the installation body. That is, the turntable 1022 and the mop 1021 can rotate relative to the installation body. After the installation body is connected with the robot body 101, the turntable 1022 is connected with the mopping rotation element 1014. When disassembling the mopping module 102, the installation body can be directly disassembled from the robot body 101.

Further, the installation body includes position A and position B spaced for a preset distance, that is, the position A is not coincided with the position B. The installation body is clamped to the robot body 101 through a clamp structure at the position A. The installation body is magnetically connected with the robot body 101 through a magnetic connection structure at the position B. The magnetic connection structure includes a magnetic element and a metal element, or includes two magnetic elements a2, etc. The clamp structure includes a clamp groove and a clamp convex, one of the clamp groove and the clamp convex is provided on the installation body, and the other of the clamp groove and the clamp convex is provided on the robot body 101. The clamp convex is a convex block, and the clamp groove is a groove structure. The clamp convex is inserted into the clamp groove to implement the clamping between the installation body and the robot body 101. Optionally, a plurality of sets of clamp grooves and clamp convexes can be provided. In a specific implementation, a plurality of clamp convexes can be provided on the installation body, and a plurality of clamp grooves can be defined on the robot body 101.

Optionally, the installation body can be provided with two turntables 1022 and two mops 1021, and the two turntables 1022 and two mops 1021 are both left-right symmetrically provided on the installation body. It should be understood that the position A and the position B can be set according to the actual requirement, which is not specifically limited here. In some examples, the position A can coincide with the position B, for example, the clamp structure is made of magnetic material, such that the installation body and the robot body 101 can be connected both by clamping and magnetic attracting through the clamp structure.

Figure 4:
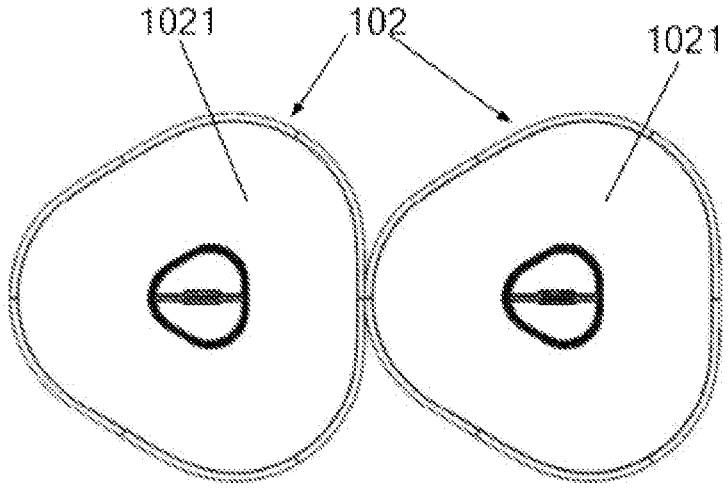
FIG. 4 is a schematic bottom view of a mopping module provided according to an embodiment of the present application.
Figure 5:
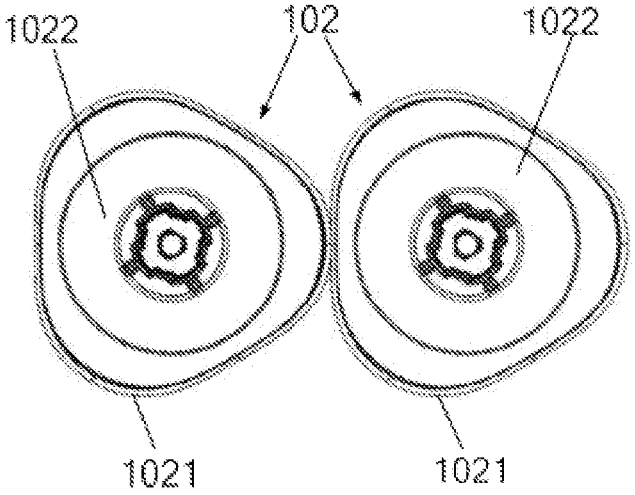
FIG. 5 is a schematic top view of a mopping module provided according to an embodiment of the present application.
Figure 6:
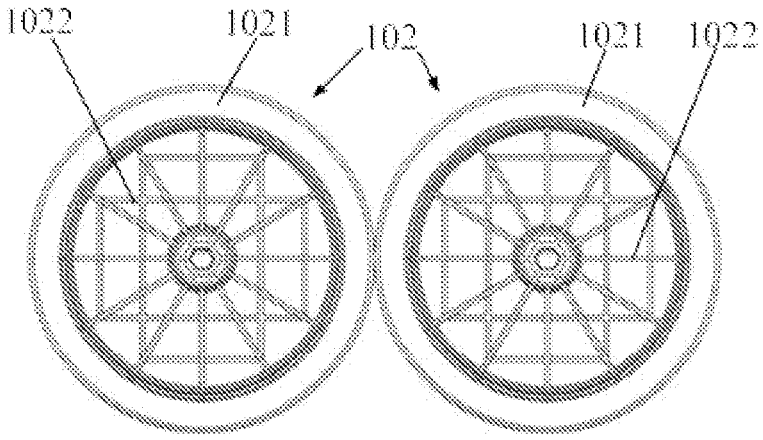
FIG. 6 is a schematic bottom view of a mopping module provided according to another embodiment of the present application.
Figure 7:
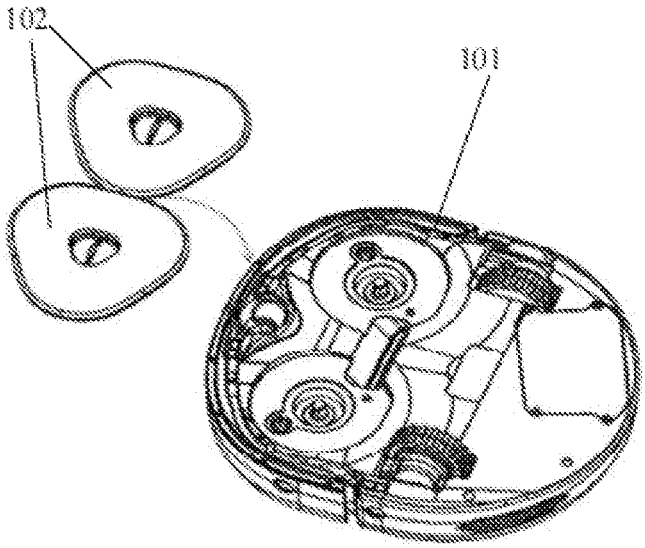
FIG. 7 is a schematic diagram of an assembly of the robot body with the mopping module in FIG. 5 according to an embodiment of the present application.

In the embodiment of the present application, when the mop 1021 of the mopping module 102 mops the floor, a contact surface of the mop 1021 contacting the floor is a mopping surface of the mop 1021. As shown in FIG. 4, the mopping surface of the mop 1021 can be a triangular shape with rounded corners. As shown in FIG. 6, the mopping surface of the mopping module can be a circle shape. Of course, the mopping surface of the mop 1021 can have any other shape, such as a regular polygon or an irregular figure, etc.

Figure 8:
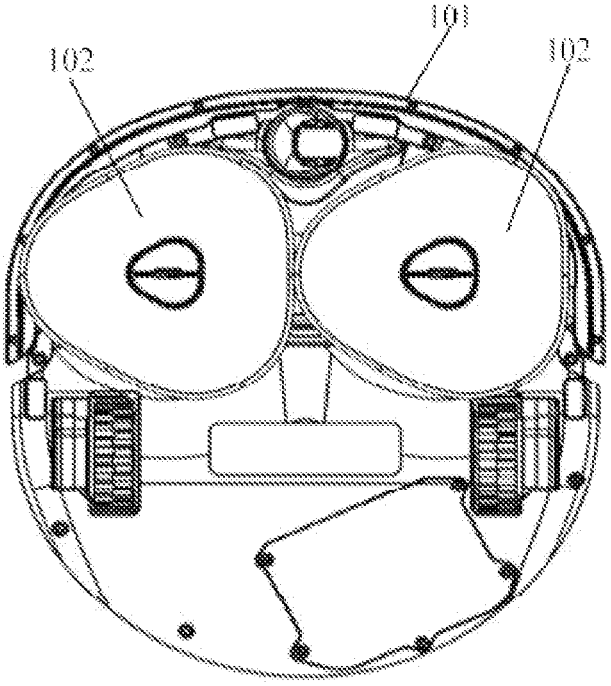
FIG. 8 is a schematic diagram of a robot body after being connected with the mopping module in FIG. 5 according to an embodiment of the present application.
Figure 9:
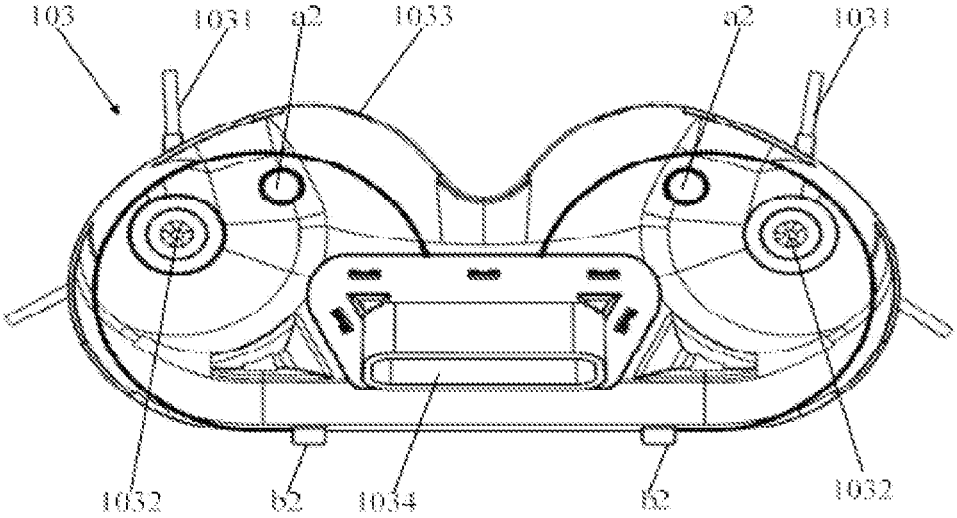
FIG. 9 is a top view of a sweeping module provided according to an embodiment of the present application.
Figure 10:
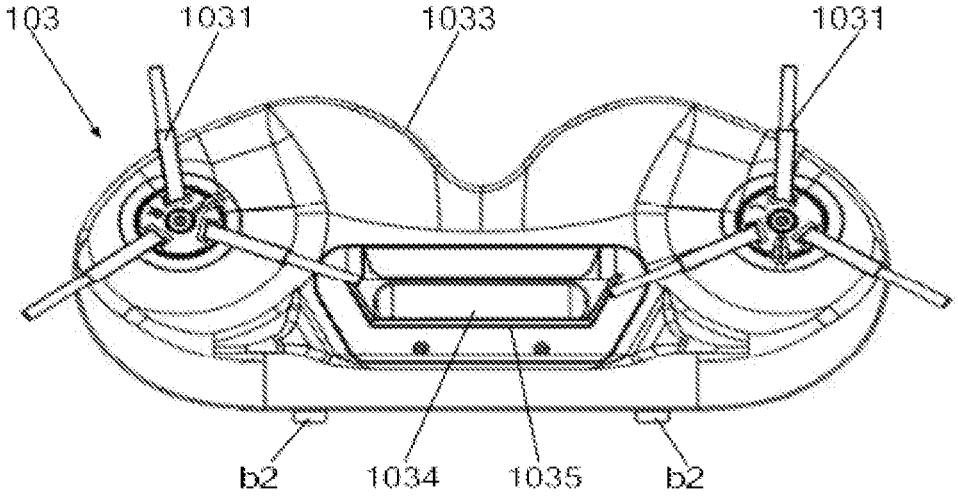
FIG. 10 is a bottom view of the sweeping module provided according to an embodiment of the present application.
Figure 11:
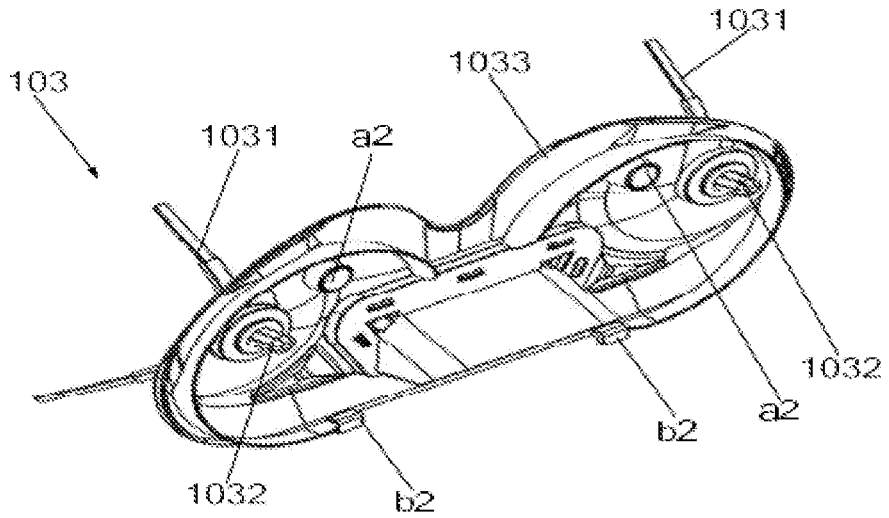
FIG. 11 is a schematic structural diagram of the sweeping module provided according to an embodiment of the present application.
Figure 12:
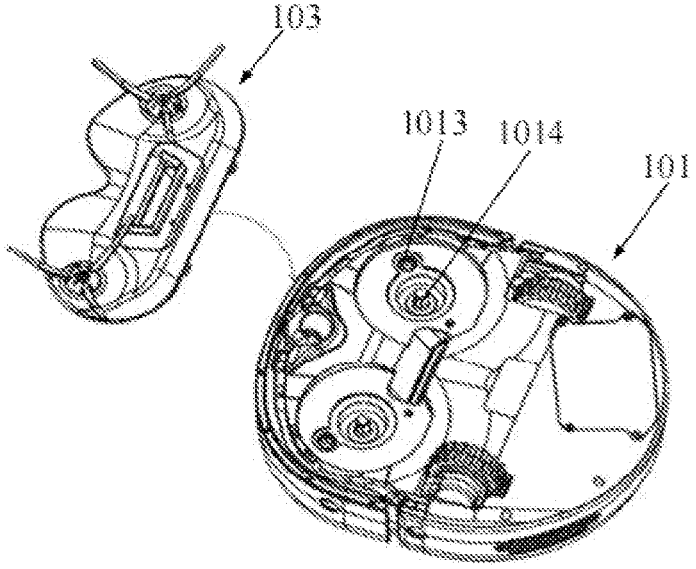
FIG. 12 is a schematic diagram of an assembly of the robot body with the sweeping module in FIG. 11 according to an embodiment of the present application.

In the embodiment of the present application, there may be one or more sets of the turntable 1022 and the mop 1021 connected with each other and included in the mopping module 102, which is not specifically limited in the embodiment of the present application. For example, as shown in FIGS. 4 and 8, the cleaning robot 100 includes two sets of the turntables 1022 and the mops 1021 that are connected with each other. When the two turntables 1022 rotate, rotation directions can be the same or reverse. In addition, when the two turntables 1022 rotate, the two mops 1021 can always keep tangent, which avoids that there exist mopping blind regions between the two mops 1021.

In the above second embodiment, an end of the mopping rotation element 1014 includes a shaft end. An end of the turntable 1022 includes a shaft sleeve. On the other hand, an end of the mopping rotation element 1014 includes a shaft sleeve. An end of the turntable 1022 includes a shaft end. The shaft sleeve is a groove structure, the shaft end can be sleeved in a groove of the shaft sleeve. In this way, the shaft end is inserted into the shaft sleeve to realize the detachable connection of the mopping rotation element 1014 and the turntable 1022.

In order to implement a torque transmission, an inner side wall of the groove of the shaft sleeve includes a non-cylinder side surface, and an outer side wall of the shaft end includes a non-cylinder side surface, the non-cylinder side surfaces of the inner side wall of the groove of the shaft sleeve and the outer side wall of the shaft end can abut against each other to implement the transmission between the shaft sleeve and the shaft end, thereby the rotation of the mopping rotation element 1014 can drive the mopping module 102 to rotate.

For example, the shaft end is provided at the end of the mopping rotation element 1014, the shaft end is a regular polygonal prism. The outer side wall of the shaft end is a polygonal prism surface. The shaft sleeve is provided on the turntable 1022 of the mopping module 102, the groove structure of the shaft sleeve is a regular polygonal prism, and the inner side wall of the groove structure of the shaft sleeve is a polygonal prism surface. After the shaft end is sleeved into the groove structure of the shaft sleeve, the detachable connection of the turntable 1022 and the mopping rotation element 1014 is achieved. When the mopping rotation element 1014 rotates, a part of the polygonal prism surface of the shaft end on the mopping rotation element 1014 abuts a part of the polygonal prism surface of the shaft sleeve of the turntable 1022 to limit a relative rotation between the mopping rotation element 1014 and the turntable 1022, thereby achieving the transmission between the mopping rotation element 1014 to the mopping module 102.

Of course, in the above mentioned second embodiment, the detachable connection of the mopping rotation element 1014 and the turntable 1022 can also be achieved through a screw connection, etc., which is not limited here.

As shown in FIGS. 8-11, the embodiments of the present application also provide a third embodiment, which is an improved solution based on the first embodiment or the second embodiment. In the third embodiment, the cleaning robot 100 further includes a sweeping module 103, which is detachably connected with the sweeping rotation element 1013. The sweeping module 103 includes a cleaning brush 1031 and a transmission element 1032, the cleaning brush 1031 is fixedly connected with the transmission element 1032, and the cleaning brush 1031 is configured for cleaning the floor. The transmission element 1032 is detachably connected with the sweeping rotation element 1013, and the sweeping rotation element 1013 is configured for driving the cleaning brush 1031 and the transmission element 1032 to rotate after the sweeping rotation element 1013 is connected with the transmission element 1032. In other words, after the transmission element 1032 is connected with the sweeping rotation element 1013, the sweeping rotation element 1013 drives the transmission element 1032 to rotate, and then the transmission element 1032 drives the cleaning brush 1031 to rotate, and the cleaning brush 1031 rotates to implement the sweeping on the floor.

In the third embodiment, after the transmission element 1032 is connected with the sweeping rotation element 1013, the rotation shaft of the sweeping rotation element 1013 coincides with the rotation shaft of the transmission element 1032. Of course, after the transmission element 1032 is connected with the sweeping rotation element 1013 for transmission, the rotation shaft of the sweeping rotation element 1013 and the rotation shaft of the transmission element 1032 can be parallel to each other and be in different positions, which is not specifically limited here. For example, a gear is provided between the transmission element 1032 and the sweeping rotation element 1013, the sweeping rotation element 1013 drives the gear to rotate, and the rotating gear drives the transmission element 1032. At this time, the rotation shaft of the sweeping rotation element 1013 and the rotation shaft of the transmission element 1032 are parallel to each other and in different positions.

As shown in FIGS. 9-13, in the third embodiment, the sweeping module 103 further includes a module body 1033, the module body 1033 is detachably connected with the robot body 101. The cleaning brush 1031 and the transmission element 1032 are both rotatably connected with the module body 1033. Rotating connection means being connected while being rotatable relative to each other. That is, both the transmission element 1032 and the cleaning brush 1031 are connected with the module body 1033, and both the transmission element 1032 and the cleaning brush 1031 can rotate relative to the module body 1033. After the module body 1033 is connected with the robot body 101, the transmission element 1032 is connected with the sweeping rotation element 1013. When to disassemble the sweeping module 103, the module body 1033 can be directly disassembled from the robot body 101.

There are many ways to connect the module body 1033 with the robot body 101. In a specific implementation, the module body 1033 includes a first position and a second position spaced for a preset distance, that is, the first position is not coincided with the second position. The module body 1033 is clamped to the robot body 101 through a clamp structure at the first position. The module body 1033 is magnetically connected with the robot body 101 through a magnetic connection structure at the second position. The magnetic connection structure can include a magnetic element a2 and a metal element a1, or the magnetic connection structure can include two magnetic elements a2 with opposite north and south poles. The magnetic element a2 can be a permanent magnet, or an electromagnet, etc., which is not specifically limited in the embodiment of the present application.

For example, the module body 1033 is provided with one of the magnetic element a2 and the metal element a1, and the robot body 101 is provided with the other of the magnetic element a2 and the metal element a1. Optionally, the magnetic element a2 can be provided on the module body 1033. The metal element a1 is provided on the robot body 101, and the magnetic connection between the module body 1033 and the robot body 101 is implemented through the attraction of the magnetic element a2 and the metal element a1. In order to ensure the stability of the magnetic connection, two left-right symmetrical metal elements a1 can be provided on the robot body 101, and two magnetic elements a2 corresponding to the two mental elements a1 on the robot body 101 can be provided on the module body 1033, respectively.

The clamp structure includes a clamp groove b1 and a clamp convex b2, the module body 1033 is provided with one of the clamp groove b1 and the clamp convex b2, the robot body 101 is provided with the other of the clamp groove b1 and the clamp convex b2. The clamp convex b2 is a convex block, and the clamp groove b1 is a groove structure. The clamp convex b2 is inserted into the clamp groove b1 to implement the clamping between the module body 1033 and the robot body 101. Optionally, a plurality of sets of clamp grooves b1 and clamp convexes b2 can be provided. In a specific implementation, a plurality of clamp convexes b2 can be provided on the module body 1033, and a plurality of clamp grooves b1 can be defined on the robot body 101.

The above-mentioned first position can be located at an edge of the module body 1033. When to connect the module body 1033 to the robot body 101, after the edge of the module body 1033 is aligned with a corresponding position of the robot body 101, the module body 1033 is clamped to the robot body 101 through the clamp structure, and then the module body 1033 is magnetically connected with the robot body 101 through the magnetic connection structure. Optionally, the first position is an edge of the rear side of the module body 1033. The bottom of the robot body 101 can be provided with a receiving groove that matches the module body 1033. After the module body 1033 is connected with the robot body 101, the module body 1033 is located inside the receiving groove. At this time, the clamp convex b2 can be provided on the side edge of the module body 1033. The clamp groove b1 is defined on a groove wall of the receiving groove.

The above-mentioned second position can be set close to the front side of the module body 1033. The front side of the module body 1033 is a side close to the head of the robot body 101, and the rear side of the module body 1033 is a side facing away from the head of the robot body 101. It should be noted that the module body 1033 can be provided with two transmission elements 1032 and two cleaning brushes 1031, and the two transmission elements 1032 and two cleaning brushes 1031 are both left-right symmetrically provided on the module body 1033. Of course, the first position and the second position of the module body 1033 can be set arbitrarily, which is not specifically limited here.

In another specific implementation, both the first position and the second position of the module body 1033 can be provided with the clamp structure, or the magnetic connection structure. In another specific implementation, the clamp structure and the magnetic connection structure are provided at a same position of the module body 1033, for example, magnetic material is used to make the clamp structure, thereby the clamping connection and the magnetic connection of the module body 1033 and the robot body 101 can be achieved through the clamp structure. In another specific implementation, the module body 1033 can also be detachably connected with the robot body 101 through screw connection, etc. Optionally, the module body 1033 of the embodiment of the present application can also be provided with a clasping, for example, the clasping is a convex block structure on the module body 1033 close to the above-mentioned first position. When disassembling the module body 1033 from the robot body 101, the user only needs to clasp the clasping of the module body 1033 with his hands and apply force to separate the magnetic element a2 and the mental element a1 of the magnetic connection structure, and then the clamp convex b2 is pulled out from the clamp groove b1, that is, the module body 1033 is disassembled.

Figure 15:
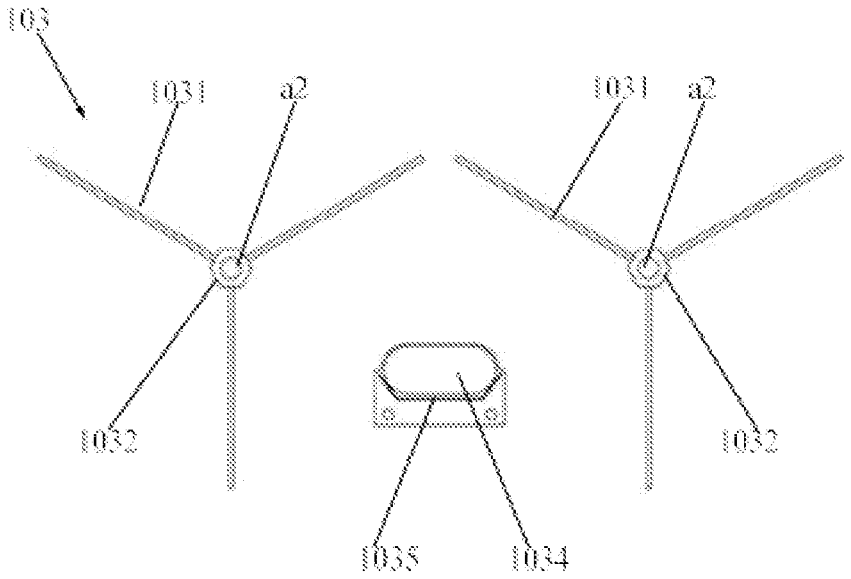
FIG. 15 is a schematic structural diagram of a sweeping module provided according to another embodiment of the present application.
Figure 16:
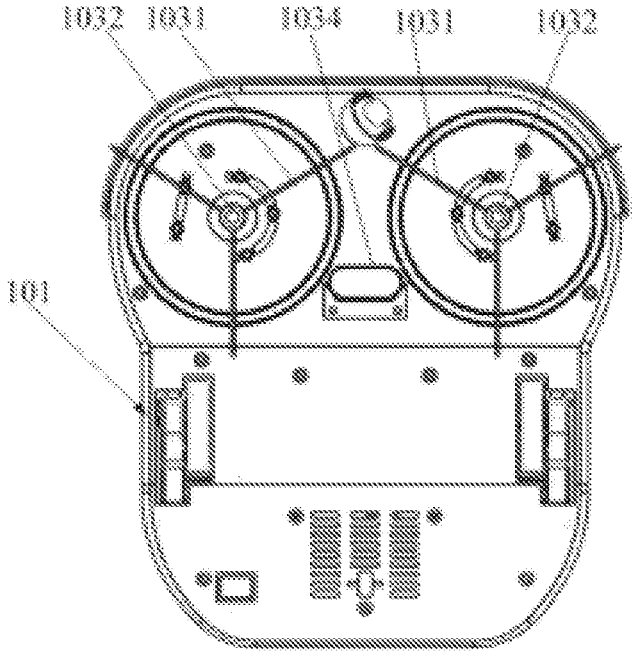
FIG. 16 is a schematic diagram of an assembly of the robot body with the sweeping module in FIG. 15 provided according to another embodiment of the present application.

As shown in FIGS. 15-16, in the third embodiment, the sweeping module 103 may not include the module body 1033. At this time, the sweeping module 103 includes the transmission element 1032 and the cleaning brush 1031, and the transmission element 1032 is fixedly connected with the cleaning brush 1031. The transmission element 1032 is detachably connected with the sweeping rotation element 1013, for example, magnetically connected through the magnetic connection structure, or connected through a screw, etc. For example, the magnetic element a2 is provided on a part of the transmission element 1032 that contacts the sweeping rotation element 1013, and the metal element a1 is provided on a part of the sweeping element 1013 that contacts the transmission element 1032.

In addition, the sweeping module 103 further includes a dust inlet 1034 cooperated with the dust suction inlet 1012 of the robot body 101, and a scraper 1035 can be provided on a rear side of the dust inlet 1034. The scraper 1035 contacts the floor to prevent the leakage of garbage. In order to prevent scratching the floor, the above-mentioned scraper 1035 can be a soft scraper, specifically the scraper 1035 can be made of silicone or rubber material. In a specific implementation, the dust inlet 1034 is an independent component. In another specific implementation, the dust inlet 1034 is provided on the module body 1033.

Figure 17:
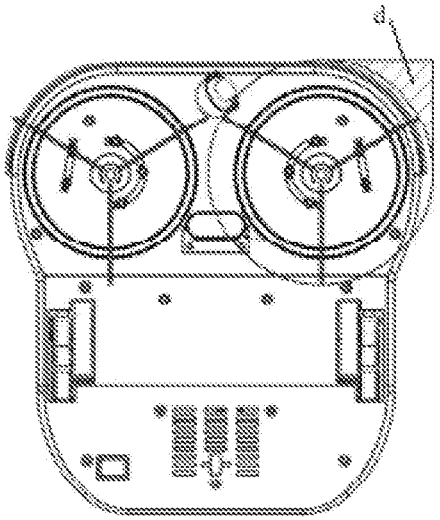
FIG. 17 is a schematic diagram of cleaning blind regions in the related art.
Figure 18:
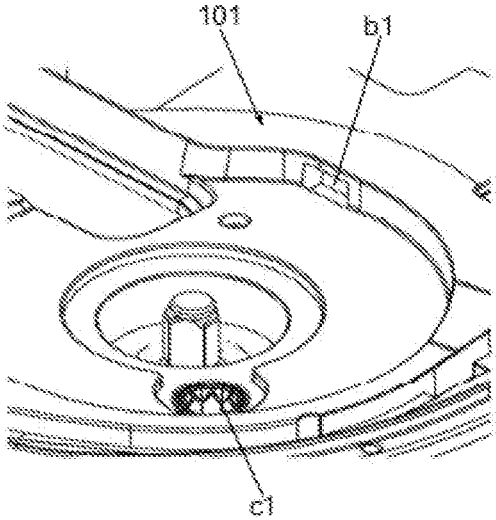
FIG. 18 is a schematic structural diagram of a shaft sleeve provided according to an embodiment of the present application.
Figure 19:
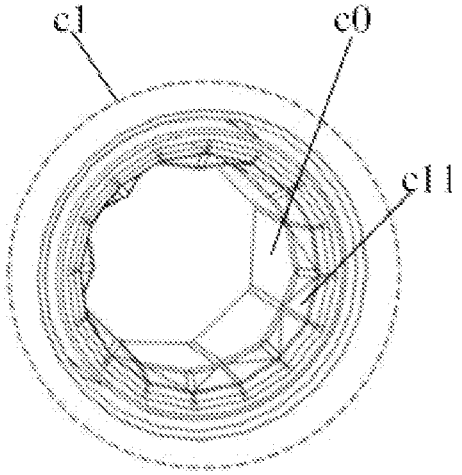
FIG. 19 is a bottom view of the shaft sleeve provided according to the embodiment of the present application.
Figure 20:
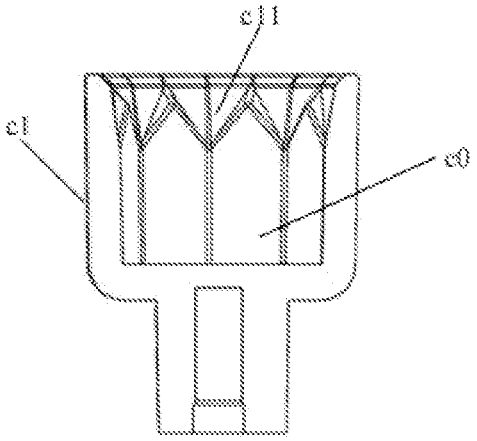
FIG. 20 is a cross-sectional view of the shaft sleeve provide according to an embodiment of the present application.
Figure 21:
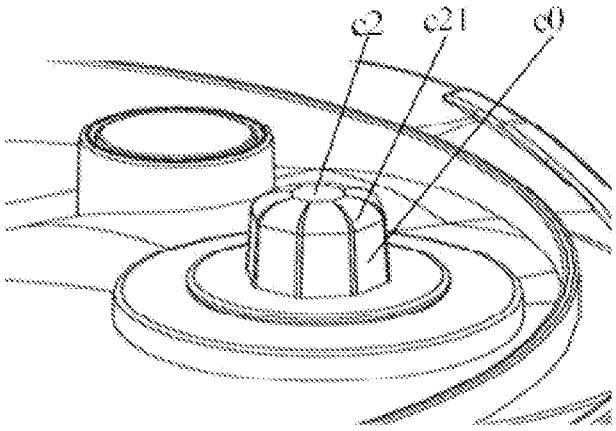
FIG. 21 is a schematic structural diagram of a shaft end provided according to an embodiment of the present application.
Figure 22:
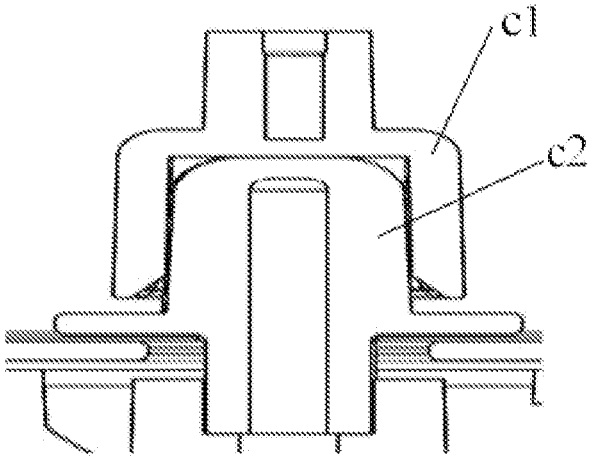
FIG. 22 is a schematic diagram of an assembly of the shaft end with the shaft sleeve according to an embodiment of the present application.

In the embodiment of the present application, as shown in FIG. 17, after the sweeping module 103 is installed on the robot body 101, during the cleaning process, the cleaning brush 1031 rotates, a cleaning range of the cleaning brush 1031 is a circular region. When the robot body 101 cleans regions such as corners of walls, etc., there will exist a cleaning blind region d. In order to avoid the existence of the cleaning blind region d. In the above-mentioned third embodiment, the cleaning brush 1031 includes a brush body fixedly connected with the transmission element 1032 and bristles provided on the brush body. After the sweeping module 103 is connected with the robot body 101, the cleaning range of the bristles is extended out of the edge of the robot body 101. In this way, it is more convenient to clean the garbage in corners that the robot body 101 cannot reach, such as the corners of walls and the vicinity of furniture. As shown in FIGS. 18-22, in the above-mentioned third embodiment, the end of the sweeping rotation element 1013 includes one of the shaft end c2 and the shaft sleeve c1, and the end of the transmission element 1032 includes the other of the shaft end c2 and the shaft sleeve c1. The shaft sleeve c1 is a groove structure, and the shaft end c2 can be sleeved in the groove of the shaft sleeve c1. In this way, the shaft end c2 is inserted in the shaft sleeve c1 to achieve a detachable connection between the sweeping rotation element 1013 and the transmission element 1032.

In order to achieve the torque transmission between the sweeping rotation element 1013 and the transmission element 1032, an inner side wall of the groove of the shaft sleeve c1 includes a non-cylinder side surface, and an outer side wall of the shaft end c2 includes a non-cylinder side surface. The non-cylinder side surface of the inner side wall of the groove of the shaft sleeve c1 and the outer side wall of the shaft end c2 can abut each other, which can limit the relative rotation between the shaft sleeve c1 and the shaft end c2, thereby achieve the transmission of the sweeping rotation element 1013 to the transmission element 1032.

For example, in the second and third embodiments, the end of the sweeping rotation element 1013 includes the shaft sleeve c1, and the end of the transmission element 1032 includes the shaft end c2. In order to ensure the circumferential positioning between the shaft sleeve c1 and the shaft end c2, the outer side wall of the shaft end c2 includes a polygonal prism surface c0, the inner side wall of the groove structure of the shaft sleeve c1 includes a polygonal prism surface c0, the polygonal prism surface c0 of the shaft end c2 and the shaft sleeve c1 are restricted by each other to limit the relative rotation between the shaft end c2 and shaft sleeve c1.

Of course, in other implementations, the outer side wall of the shaft end c2 is further provided with one of a convex and a groove, and the inner side wall of the shaft sleeve c1 is further provided with the other of the convex and the groove. The convex is clamped in the groove to limit the relative rotation between the shaft end c2 and the shaft sleeve c1. The connection between the shaft sleeve c1 and the shaft end c2 is not specifically limited in the embodiments of the present application.

Optionally, in a specific implementation, the sweeping module 103 includes the module body 1033 detachably connected with the robot body 101, the cleaning brush 1031, and the transmission element 1032 fixedly connected with the cleaning brush 1031. The end of the sweeping rotation element 1013 includes one of the shaft end c2 and the shaft sleeve c1, and the end of the transmission element 1032 includes the other of the shaft end c2 and the shaft sleeve c1. For example, the end of the sweeping rotation element 1013 includes the shaft sleeve c1, the end of the transmission element 1032 includes the shaft end c2. The shaft end c2 is sleeved in the groove structure of the shaft sleeve c1. The groove structure of the shaft sleeve c1 is a polygonal prism structure, and the shaft end c2 is also a polygonal prism structure. At this time, in order to facilitate assembly, an opening of the shaft sleeve c1 can be defined with a plurality of guide grooves c11, and each of the guide grooves c11 includes two groove walls, a distance between the two groove walls of the guide groove c11 is gradually decreased from the opening of the shaft sleeve c1 to a bottom of the shaft sleeve c1, and finally the two groove walls of the guide groove c11 interact at a side arris of the polygonal prism surfaces c0 of the shaft sleeve c1. A top of the shaft end c2 is provided with a plurality of guide surfaces c21. Each of the guide surfaces c21 includes two side edges. A distance between the two side edges of the guide surface c21 is gradually increased from the top of the shaft end c2 to a bottom of the shaft end c2. The side edges of the guide surface c21 intersect the side edges of the polygonal prism surface c0 of the shaft end c2.

In the above-mentioned solution, the plurality of guide grooves c11 are circumferentially distributed along the opening of the shaft sleeve c1, the plurality of guide surfaces c21 are circumferentially distributed along the top of the shaft end c2, and the plurality of guide surfaces c21 are respectively cooperated with the plurality of guide grooves c11. When the sweeping module 103 is assembled to the robot body 101, the guide surfaces c21 of the shaft end c2 move and rotate along the guide groove c11 to gradually approach the bottom of the shaft sleeve c1. The specific process is that the groove walls of the guide groove c11 and the side edges of the guide surfaces c21 abut each other and produce a force. Due to one of the shaft end c2 and the shaft sleeve c1 is provided on the transmission element 1032, the other of the shaft end c2 and the shaft sleeve c1 is provided on the sweeping rotation element 1013, and the transmission element 1032 can rotate relative to the module body 1033, so that under the action of the force, the shaft end c2 can rotate relative to the shaft sleeve c1. That is, the transmission element 1032 rotates relative to the sweeping rotation element 1013.

Due to two groove walls of each guide groove c11 converge at a side edge of the polygonal prism surface c0 of the shaft sleeve c1, and the side edge of the guide surface c21 intersects the side arris of the polygonal prism surface c0 of the shaft end c2, under the guidance of the groove walls of the guide groove c11 and the side edges of the guide surface c21, the shaft end c2 and the shaft sleeve c1 rotate relative to each other until the polygonal prism surfaces c0 of the shaft end c2 and the shaft sleeve c1 are corresponding to each other, so that the shaft end c2 is inserted into the groove structure of the shaft sleeve c1. At this time, the shaft end c2 and the shaft sleeve c1 achieve circumferential positioning through the polygonal prism surfaces c0 to limit the relative rotation between the shaft end c2 and the shaft sleeve c1.

Figure 13:
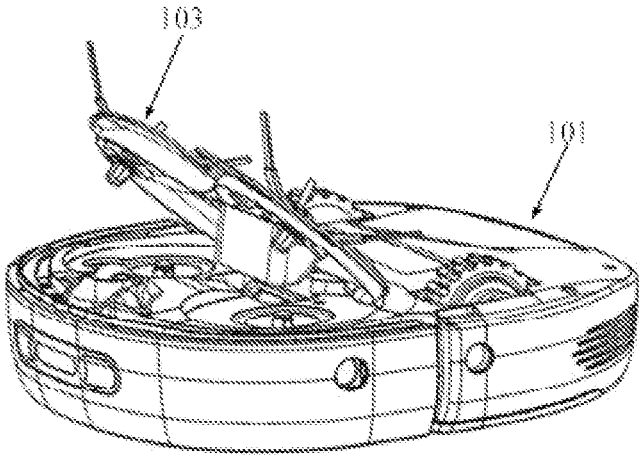
FIG. 13 is schematic diagram of another assembly of the robot body with the sweeping module in FIG. 11 according to an embodiment of the present application.
Figure 14:
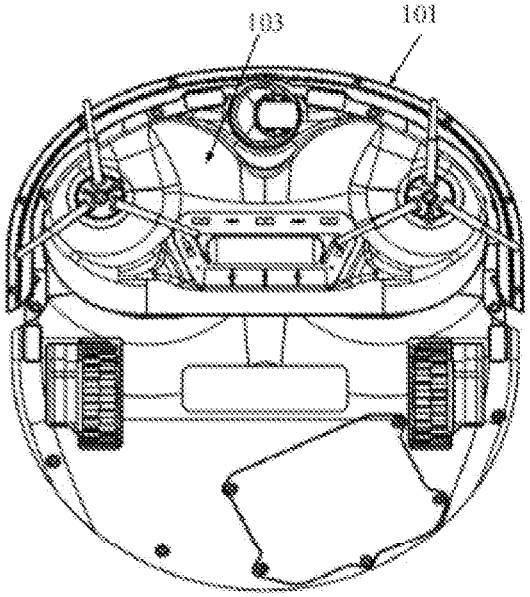
FIG. 14 is schematic diagram of another assembly of the robot body with the sweeping module in FIG. 11 according to an embodiment of the present application.

The following is an exemplary description of the installation steps of the sweeping module 103. In this example, the sweeping module 103 includes the module body 1033. The clamp convex b2 is provided on the side edge of the module body 1033, and a magnet spaced a predetermined distance from the clamp convex b2 is provided on the module body 1033. The installation steps of the sweeping module 103 are as follows: as shown in FIG. 13, at first the clamp convex b2 of the sweeping module 103 is inserted into the clamp groove b1 of the robot body 101, where the groove b1 is provided on the side wall of the receiving groove defined at the bottom of the robot body 101. Then, a position where the clamp convex b2 intersects the clamp groove b1 is taken as a fulcrum, the sweeping module 103 is rotated toward the robot body 101. The shaft end c2 of the transmission element 1032 includes the guide surfaces c21, and the shaft sleeve c1 of the sweeping rotation element 1013 includes the guide grooves c11. Under the guidance of the guide grooves c11 and the guide surfaces c21, the guide grooves c11 applies a force to the guide surfaces c21. Due to the transmission element 1032 is fixedly connected with the cleaning brush 1031, under the action of the force, the transmission element 1032 and the cleaning brush 1031 is rotated for a certain angle relative to the module body 1033, and the shaft end c2 of the transmission element 1032 is inserted into the shaft sleeve c1 of the sweeping rotation element 1013. When the module body 1033 is attached to the robot body 101, the magnet on the module body 1033 is magnetically connected with the metal element a1 on the robot body 101. Under the magnetic connection and the clamping of the clamp convex b2 and the clamp groove b1, the module body 1033 is stably connected with the robot body 101.

Correspondingly, the disassembly steps of the sweeping module 103 are as follows: due to that the magnetic force of the magnet is not designed to be very large but only needs to stably connect the sweeping module 103 with the robot body 101, the user can clasp the clasping position provided in the middle of the side edge of the module body 1033 to separate the module body 1033 from the robot body 101, that is, the magnetic connection of the module body 1033 and the robot body 101 can be cut, after the module body 1033 is rotated for a certain angle, the clamp convex b2 of the sweeping module 103 is pulled out from the clamp groove b1, that is, the sweeping module 103 is disassembled from the robot body 101.

In the embodiment of the present application, the cleaning brush 1031 and the transmission element 1032 are provided on the module body 1033. The sweeping module 103 is detachably connected with the robot body 101 through the module body 1033. The module body 1033 includes a first surface and a second surface facing away from the first surface. When the module body 1033 is installed on the robot body 101, the first surface of the module body 1033 faces the bottom of the robot body 101. For example, the first surface of the module body 1033 is fitted with the bottom of the robot body 101 or there is a gap between the first surface of the module body 1033 and the bottom of the robot body 101. The second surface of the module body 1033 faces an outside of the robot body 101. At this time, one side of the transmission element 1032 close to the first surface of the module body 1033 is in connection with the sweeping rotation element 1013 for transmission. When the user installs the sweeping module 103, the second surface of the module body 1033 faces the user, thereby making it difficult for the user to observe a connection position of the transmission element 1032 and the sweeping rotation element 1013, and it is not easy to align the polygonal prism surface c0 of the shaft end c2 with the polygonal prism surface c0 of the shaft sleeve c1. However, after the guide groove c11 is provided at the opening of the shaft sleeve c1 and the guide surface c21 is provided at the top of the shaft end c2, the force produced by the abutment between the groove wall of the guide groove c11 and the side edge of the guide surface c21 can be used to make the shaft end c2 rotate relative to the shaft sleeve c1 to correct a position of the shaft end c2 relative to the shaft sleeve c1. When the user installs the module body 1033 on the robot body 101, even if the user cannot observe the assembly position of the transmission element 1032 and the sweeping rotation element 1013, it is also ensured that the polygonal prism surface c0 of the shaft end c2 can be smoothly inserted into the polygonal prism surface c0 of the shaft sleeve c1, especially when the detachable connection of the module body 1033 and the robot body 101 is implemented through the clamping of the clamp structure and the magnetic connection of the magnetic connection structure. The user can first make the clamp structure clamp to position the module body 1033 and the robot body 101, as shown in FIG.13, and then take the clamp structure as the fulcrum to rotate the module body 1033 toward the robot body 101. Due to that the clamp structure achieves a relative positioning of the module body 1033 and the robot body 101, when the module body 1033 is attached to the robot body 101, the positions of the transmission element 1032 and the sweeping rotation element 1013 are preliminarily positioned. Then, the detachable connection of the transmission element 1032 and the sweeping rotation element 1013 is achieved through inserting the shaft end c2 into the shaft sleeve c1. During the process of inserting the shaft end c2 into the shaft sleeve c1, the groove wall of the guide groove c11 and the side edge of the guide surface c21 cooperate to make the shaft end c2 and the shaft sleeve c1 be accurately positioned, which makes it more convenient for the installation and circumferential positioning of the shaft sleeve c1 and the shaft end c2 during the connection process.

Of course, in the above-mentioned third embodiment, in addition to the connection of the sweeping module 103 and the robot body 101 through the module body 1033, the sweeping rotation element 1013 is connected with the transmission element 1032 through screws, etc. to achieve the detachable connection between the sweeping module 103 and the robot body 101, which is limited in the embodiment of the present application here.

In the following, based on the use of the sweeping module 103 and the mopping module 102, the effect of the solution that the sweeping rotation element 1013 and the mopping rotation element 1014 are provided with different shafts will be described, the solution is that: the sweeping rotation element 1013 is located in front of the mopping rotation element 1014 along the first direction, and the sweeping rotation element 1013 is also located in front of the mopping rotation element 1014 along the second direction. The first direction is the forward movement direction of the cleaning robot 100. The second direction is perpendicular to the forward movement direction of the cleaning robot 100 and points to the target side of the robot body 101. The target side is the side between the foremost position and the last position of the robot body 101 along the first direction.

The sweeping rotation element 1013 and the mopping rotation element 1014 are provided with different shafts. The sweeping rotation element 1013 is located at the left front or the right front of the mopping rotation element 1014 along the forward movement direction of the cleaning robot 100, the sweeping rotation element 1013 is closer to the edge of the robot body 101 than the mopping rotation element 1014. When the rotation shaft of the cleaning brush 1031 coincides with the rotation shaft of the sweeping rotation element 1013, that is, the transmission element 1032 of the sweeping module 103 is fixedly connected with the cleaning brush 1031. The transmission element 1032 is detachably connected with the sweeping rotation element 1013. The rotation of the sweeping rotation element 1013 drives the transmission element 1032 and the cleaning brush 1031 to rotate. At this time, the length of the cleaning brush 1031 can be set to be shorter, which can also ensure that the cleaning range of the cleaning brush 1031 is extended out of the edge of the robot body 101, thereby avoiding the linear velocity of the end of the cleaning brush 1031 to be larger caused by the length of the side brush of the cleaning brush 1031 being too long, and the end of the cleaning brush 1031 throwing garbage out of the region covered by the bottom of the robot body 101.

During the cleaning process of the cleaning robot 100, when the cleaning brush 1031 rotates, the cleaning range of the cleaning brush 1031 is a circular region. When the mop 1021 of the mopping module 102 rotates, the cleaning range of the mop 1021 is also a circular region. After the mopping module 102 is installed on the robot body 101, in order to prevent the edge of the mopping module 102 from colliding with obstacles during the cleaning process, the edge of the mopping module 102 is located inside the edge of the robot body 101. If the mopping rotation element 1014 is also used to connect the transmission element 1032 of the sweeping module 103 to make the mopping rotation element 1014, the transmission element 1032 and the cleaning brush 1031 rotate coaxially, due to the cleaning range of the cleaning brush 1031 is a circular region and the length of the cleaning brush 1031 is not suitable to be set to be long, the cleaning blind region d as shown in FIG. 17 is produced. When the cleaning robot 100 cleans regions such as corners of walls, etc., the cleaning blind region d will cause a vertex position of the corners not to be cleaned.

For such reason, the sweeping rotation element 1013 and the mopping rotation element 1014 are provided with different shafts. The sweeping rotation element 1013 is located at the left front or the right front of the mopping rotation element 1014. The sweeping rotation element 1013 is closer to the edge of the robot body 101 than the mopping rotation element 1014, such that when the length of the cleaning brush 1031 is set to be shorter, the cleaning range of the cleaning brush 1031 can also extend out of the edge of the robot body 101 to cover the cleaning blind region d shown in FIG. 17, thereby reducing the region of the floor that can not be cleaned by the cleaning robot 100.

In some examples, parts of the cleaning brush 1031 extended out of the edge of the robot body 101 are bristles. When these bristles collide with an obstacle, the bristles can be deformed, so that the cleaning work of the cleaning brush 1031 is not affected by the collision with the obstacle.

In the embodiment of the present application, the cleaning robot 100 can use a same drive motor 10161 to drive the sweeping rotation element 1013 and the mopping rotation element 1014, so as to reduce the components of the cleaning robot 100.

Figure 23:
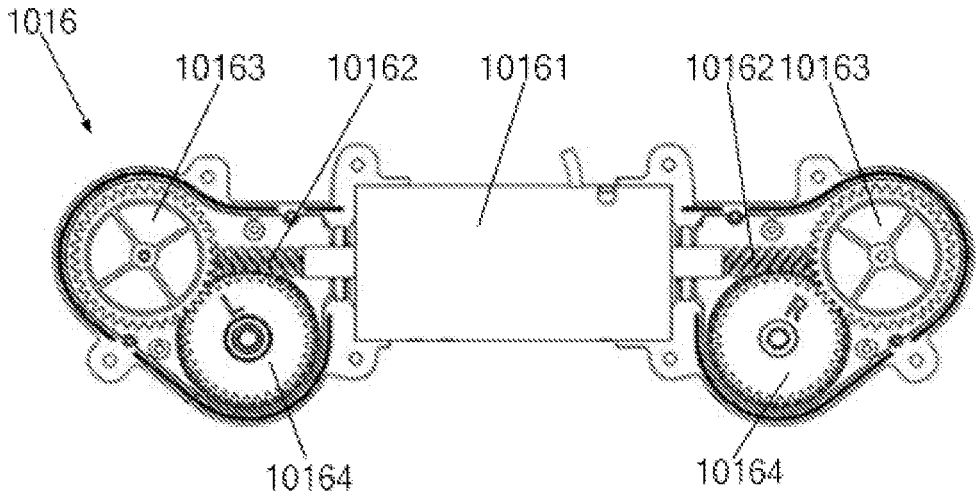
FIG. 23 is a schematic structural diagram of a drive device provided according to an embodiment of the present application.
Figure 24:
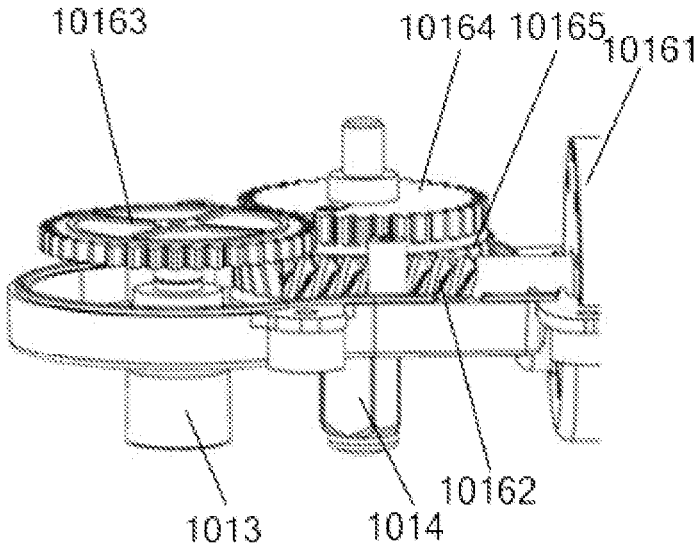
FIG. 24 is a schematic structural diagram of a part of the drive device provided according to an embodiment of the present application.

As shown in FIGS. 23-24, the present application also provides a fourth embodiment, which is improved based on any one of the above-mentioned first to third embodiments. In the fourth embodiment, the drive device 1016 includes a drive motor 10161 and a power transmission structure connected with an output end of the drive motor 10161. The drive motor 10161 is configured for driving the sweeping rotation element 1013 and the mopping rotation element 1014 to rotate through the power transmission structure. In other words, power transmission is implemented between the sweeping rotation element 1013 and the output end of the drive motor 10161 as well as between the mopping rotation element 1014 and the output end of the drive motor 10161 through the power transmission structure, and finally the power of the drive motor 10161 is transmitted to the sweeping rotation element 1013 and the mopping rotation element 1014 to drive the sweeping rotation element 1013 and the mopping rotation element 1014 to rotate.

Optionally, the power transmission structure includes a gear set and a worm 10162, and the worm 10162 is configured for driving the gear set to rotate, the gear set is respectively connected with the sweeping rotation element 1013 and the mopping rotation element 1014. The worm 10162 is fixedly connected with the output end of the drive motor 10161 to obtain the power output by the drive motor 10161. The rotation of the output end of the drive motor 10161 drives the worm 10162 to rotate, and then the worm 10162 drives the gear set to rotate. the gear set includes a plurality of mutually linked gears. At least one of the plurality of gears of the gear set is meshed with the sweeping rotation element 1013 and at least one of the plurality of gears of the gear set is meshed with the mopping rotation element 1014 to drive the sweeping rotation element 1013 and the mopping rotation element 1014 to rotate during the rotation of the gear set.

Optionally, the gear set includes a first gear and a second gear 10163, the first gear includes a first sub-gear 10164 and a second sub-gear 10165 fixedly connected with the first sub-gear 10164. A rotation shaft of the first sub-gear 10164 coincides with that of the second sub-gear 10164. The first sub-gear 10164 meshes with the second gear 10163, the second sub-gear 10165 meshes with the worm 10162. That is, the first sub-gear 10164 and the second sub-gear 10165 are coaxially provided and rotate synchronously. When rotating, the worm 10162 drives the second sub-gear 10165 to rotate, and the second sub-gear 10165 rotates to drive the first sub-gear 10164 to rotate, and the first sub-gear 10164 rotates to drive the second gear 10163 to rotate.

In one solution, the first gear is connected with the sweeping rotation element 1013, so that the first gear is coaxially meshed with the sweeping rotation element 1013. The second gear 10163 is connected with the mopping rotation element 1014, so that the second gear 10163 is coaxially meshed with the mopping rotation element 1014. The sweeping rotation element 1013 can be used as the rotation shaft of the first gear, and when rotating, the first gear drives the sweeping rotation element 1013 to rotate. Specifically, the first sub-gear 10164 of the first gear is connected with the sweeping rotation element 1013. The mopping rotation element 1014 can be used as a rotation shaft of the second gear 10163, and when rotating, the second gear 10163 drives the mopping rotation element 1014 to rotate.

In another solution, the first gear is connected with the mopping rotation element 1014, so that the first gear is coaxially meshed with the mopping rotation element 1014. The second gear 10163 is connected with the sweeping rotation element 1013, so that the second gear 10163 is coaxially meshed with the sweeping rotation element 1013. In some examples, the mopping rotation element 1014 can be used as the rotation shaft of the first gear, and when rotating, the first gear drives the mopping rotation element 1014 to rotate. Specifically, the first sub-gear 10164 or the second sub-gear 10165 of the first gear is connected with the mopping rotation element 1014, or both the first sub-gear 10164 and the second sub-gear 10165 are connected with the mopping rotation element 1014. The sweeping rotation element 1013 can be used as a rotation shaft of the second gear 10163, and when rotating, the second gear 10163 drives the sweeping rotation element 1013 to rotate. For example, as shown in FIGS. 23 and 24, the first gear includes the first sub-gear 10164 and the second sub-gear 10165 provided in upper and lower layers. The second sub-gear 10165 meshes with the worm 10162, the first sub-gear 10164 is provided above the second sub-gear 10165, and the first sub-gear 10164 is fixedly connected with the second sub-gear 10165. A middle of the first gear is sleeved on the mopping rotation element 1014. The first gear is fixedly connected with the mopping rotation element 1014, and the rotation shafts of the first sub-gear 10164, the second sub-gear 10165 and the mopping rotation element 1014 coincide with each other. The first sub-gear 10164 meshes with the second gear 10163, the second gear 10163 is fixedly connected with the sweeping rotation element 1013, and the rotation shafts of the second gear 10163 and the sweeping rotation element 1013 coincide with each other. In this way, the drive motor 10161 drives the worm 10162 to rotate, and the worm 10162 drives the second sub-gear 10165 to make the first sub-gear 10164 and the second sub-gear 10165 rotate together, that is, the worm 10162 drives the first gear to rotate, so that the mopping rotation element 1014 follows the first gear. The rotating first sub-gear 10164 drives the second gear 10163 to rotate, so that the sweeping rotation element 1013 follows the second gear 10163.

In this way, through the use of the first gear and the second gear 10163, that is, the sweeping rotation element 1013 and the mopping rotation element 1014 can be driven to rotate respectively. In addition, the first gear and the second gear 10163 can be adjusted according to the specific positions of the sweeping rotation element 1013 and the mopping rotation element 1014. For example, the size of the first gear and the second gear 10163 are adjusted according to the distance between the sweeping rotation element 1013 and the mopping rotation element 1014 to ensure the transmission between the first gear and the second gear 10163.

In the fourth embodiment, the sweeping rotation element 1013 and the mopping rotation element 1014 share the same drive motor 10161. When the cleaning robot 100 includes two sweeping rotation elements 1013 and two mopping rotation elements 1014, the two sweeping rotation elements 1013 and the two mopping rotation elements 1014 are both left-right symmetrically provided at the bottom of the robot body 101. At this time, two worms 10162 and two gear sets can be set. The second sub-gears 10165 of the two gear set mesh with the two worms 10162 respectively. The drive motor 10161 can be a double-headed motor. One gear set drives the sweeping rotation element 1013 and the mopping rotation element 1014 on the left side to rotate, and the other gear set drives the sweeping rotation element 1013 and the mopping rotation element 1014 on the right side to rotate.

Optionally, two drive motors 10161 can also be provided. One drive motor 10161 drives the sweeping rotation element 1013 and the mopping rotation element 1014 on the left side to rotate through the power transmission structure, and the other drive motor 10161 drives the sweeping rotation element 1013 and the mopping rotation element 1014 on the right side to rotate through the power transmission structure.

It should be understood that the power transmission structure can also be embodied in other implementations, such as a belt structure, etc. For example, the output end of the drive motor 10161 includes two coaxial transmission wheels. One transmission wheel is connected with the sweeping rotation element 1013 through a belt, and the other transmission wheel is connected with the mopping rotation element 1014 through a belt, so that the drive motor 10161 can drive the sweeping rotation element 1013 and the mopping rotation element 1014 to rotate.

To sum up, when the cleaning robot provided according to the embodiment of the present application is used, the sweeping rotation element and the mopping rotation element are provided at different positions at the bottom of the robot body, and the drive device can drive the sweeping rotation element and the mopping rotation element to rotate. According to actual requirement, the sweeping rotation element can be connected with the sweeping module. After the sweeping rotation element is connected with the sweeping module, a rotation of the sweeping rotation element drives the sweeping module to rotate to implement the sweeping on the floor. Or, the mopping rotation element can be connected with the mopping module, after the mopping rotation element is connected with the mopping module, a rotation of the mopping rotation element drives the mopping module to rotate to implement the mopping on the floor. In this way, the cleaning robot of the embodiments of the present application can implement sweeping and mopping functions with fewer elements. When the sweeping module is used, the cleaning robot can sweep the floor, and when the mopping module is used, the cleaning robot can mop the floor. In this way, the sweeping and mopping of the cleaning robot on the floor are not affected by each other, and the cleaning effect of the sweeping module and the mopping module on the floor can be increased through the transmission of the sweeping rotation element and the mopping rotation element, so that the cleaning robot has various cleaning functions and better cleaning effects.

The various embodiments in this specification are described in a progressive manner. Each embodiment focuses on the differences from the other embodiments. The same and similar parts of the various embodiments can refer to each other.

The above description of the disclosed embodiments enables those skilled in the art to implement or use the present application. Various modifications to these embodiments will be obvious to those skilled in the art, and the general principles defined herein can be implemented in other embodiments without departing from the spirit or scope of the present application. Therefore, the present application will not be limited to the embodiments shown herein, but should be in conformity with the widest scope consistent with the principles and novel features disclosed herein.

What is claimed is:

1. A cleaning robot, comprising:

a robot body provided with a sweeping rotation element and a mopping rotation element at different positions at a bottom of the robot body;

a drive device provided on the robot body and configured for driving the sweeping rotation element and the mopping rotation element to rotate;

a sweeping module and a mopping module, the sweeping module or the mopping module being installed on the robot body;

wherein the sweeping module comprises a module body detachably connected with the robot body and a sweeping transmission element detachably connected with the sweeping rotation element, and the sweeping module is configured for sweeping a floor; the mopping rotation element is provided to be detachably connected with the mopping module, and the mopping module is configured for mopping the floor;

wherein, in a first configuration the mopping module is connected with the mopping rotation element, then the sweeping rotation element is covered by the mopping module; and in a second configuration the sweeping transmission element of the sweeping module is connected with the sweeping rotation element, then the mopping rotation element is covered by the module body of the sweeping module.

2. The cleaning robot according to claim 1, wherein the sweeping rotation element is located in front of the mopping rotation element along a first direction;

the sweeping rotation element is located in front of the mopping rotation element along a second direction;

the first direction is a forward movement direction of the cleaning robot;

the second direction is perpendicular to the forward movement direction of the cleaning robot and points to a target side of the robot body, and the target side is a side between a foremost position and a last position of the robot body along the forward movement direction of the cleaning robot.

3. A cleaning robot, comprising:

a robot body provided with a sweeping rotation element and a mopping rotation element at different positions at a bottom of the robot body;

a sweeping module and a mopping module, the sweeping module or the mopping module being installed on the robot body;

wherein the sweeping module comprises a module body detachably connected with the robot body and a sweeping transmission element detachably connected with the sweeping rotation element, and the sweeping module is configured for sweeping a floor; the mopping rotation element is provided to be detachably connected with the mopping module, and the mopping module is configured for mopping the floor;

wherein, in a first configuration the mopping module is connected with the mopping rotation element, then the sweeping rotation element is covered by the mopping module; and in a second configuration the sweeping transmission element of the sweeping module is connected with the sweeping rotation element, then the mopping rotation element is covered by the module body of the sweeping module.

4. The cleaning robot according to claim 3, wherein the sweeping rotation element is located between front and side of the mopping rotation element, thereby the sweeping module or the mopping module being installed on the robot body.

5. The cleaning robot according to claim 3, wherein the sweeping rotation element is located in front of the mopping rotation element along a first direction;

the sweeping rotation element is located in front of the mopping rotation element along a second direction;

the first direction is a forward movement direction of the cleaning robot;

the second direction is perpendicular to the forward movement direction of the cleaning robot and points to a target side of the robot body, and the target side is a side between a foremost position and a last position of the robot body along the forward movement direction of the cleaning robot.

6. The cleaning robot according to claim 3, wherein the sweeping rotation element is closer to an edge of a head of the robot body and closer to the target side of the robot body than the mopping rotation element, thereby a cleaning range of a cleaning brush installed on the sweeping rotation element extends out of an edge of the robot body.

7. The cleaning robot according to claim 3, wherein when the robot body is placed on a plane, a rotation of the sweeping rotation element is able to be perpendicular or slightly inclined to the plane, a rotation of the mopping rotation element is perpendicular or slightly inclined the plane.

* * * * *